US010407843B2

(12) United States Patent
Anheier et al.

(10) Patent No.: US 10,407,843 B2
(45) Date of Patent: Sep. 10, 2019

(54) ROAD PAVER WITH VIEWING INDENTATION IN MATERIAL CONTAINER

(71) Applicant: BOMAG GmbH, Boppard (DE)

(72) Inventors: Thorsten Anheier, Kobern-Gondorf (DE); Thomas Haubrich, Goedenroth (DE); Thomas Klein, Wehr (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 15/887,249

(22) Filed: Feb. 2, 2018

(65) Prior Publication Data

US 2018/0223486 A1 Aug. 9, 2018

(30) Foreign Application Priority Data

Feb. 3, 2017 (DE) ..... 10 2017 001 000

(51) Int. Cl.
*E01C 19/43* (2006.01)
*E01C 19/23* (2006.01)
*E01C 19/48* (2006.01)

(52) U.S. Cl.
CPC ..... *E01C 19/43* (2013.01); *E01C 19/238* (2013.01); *E01C 19/48* (2013.01); *E01C 19/488* (2013.01); *E01C 2301/30* (2013.01); *E01C 2301/40* (2013.01)

(58) Field of Classification Search
CPC ..... E01C 19/48; E01C 19/4873; E01C 19/43; E01C 19/238; E01C 19/488; E01C 19/23
See application file for complete search history.

(56) References Cited

U.S. PATENT DOCUMENTS 5,546,123 A * 8/1996 Ikeda ..... E01C 19/006 348/119
6,997,641 B2 * 2/2006 Gaertner ..... E01C 23/08 404/93
7,753,620 B2 * 7/2010 Kotting ..... E01C 19/004 299/39.4

(Continued)

FOREIGN PATENT DOCUMENTS

EP 2918726 A1 9/2015

OTHER PUBLICATIONS

Sumitomo Construction Machinery Manufacturing Co., Ltd., Brochure for Jpaver Sumitomo Asphalt Paver HA60W-7 HA60C-7, URL: http://www.sumitomokenki.com/asphalt_paver/ha60w-7.html, Chiba, Japan, 2009 (6 pages).

(Continued)

*Primary Examiner* — Abigail A Risic
(74) *Attorney, Agent, or Firm* — Wood Herron & Evans LLP

(57) ABSTRACT

A road paver for paving paving material in a paving direction (a) is provided comprising a machine frame, a driver's platform, a drive motor, a chassis with at least a left travel unit and a right travel unit, a material container arranged at the front of the road paver in the paving direction (a) for receiving paving material, the material container comprising a left container half and a right container half, which each have a container floor, a rising container sidewall and a rising container rear wall, and a longitudinal conveying device configured to transport paving material from the material container to a paving screed arranged at the rear of the road paver in the paving direction.

17 Claims, 13 Drawing Sheets

(56) References Cited

U.S. PATENT DOCUMENTS

| | | | | |
|---|---|---|---|---|
| 9,399,848 | B2 * | 7/2016 | Haubrich | B62D 33/06 |
| 2016/0024726 | A1 * | 1/2016 | Anderson | E01C 19/48<br>404/108 |
| 2016/0040368 | A1 * | 2/2016 | Frelich | E01C 19/48<br>404/110 |
| 2016/0060823 | A1 * | 3/2016 | Erdtmann | E01C 19/48<br>404/110 |
| 2018/0002874 | A1 * | 1/2018 | Jacob | E01C 19/48 |

OTHER PUBLICATIONS

German Patent Office, German Search Report, Application No. 10 2017 001 000.5, dated Dec. 22, 2017 (8 pages).

* cited by examiner

ROAD PAVER WITH VIEWING INDENTATION IN MATERIAL CONTAINER

CROSS-REFERENCE TO RELATED APPLICATION

The present application claims priority under 35 U.S.C. § 119 of German Patent Application No. 10 2017 001 000.5, filed Feb. 3, 2017, the disclosure of which is hereby incorporated herein by reference in its entirety.

FIELD OF THE INVENTION

The present invention relates to a road paver for paving paving material in a paving direction.

BACKGROUND OF THE INVENTION

Generic road pavers are normally used in street or road construction or when creating squares or other paved areas. Their main function is the distribution of paving material, e.g., asphalt or concrete, on the ground and the creation of an even, at least pre-compacted layer of paving material. Road pavers generally have a machine frame, a driver's platform and a drive engine, e.g., a combustion engine, generally a diesel combustion engine. They are self-propelled machines comprising a chassis with at least a left travel unit and a right travel unit. In this regard, both road pavers with crawler tracks as well as road pavers with wheels are known and comprised by the present invention. In order to receive paving material, road pavers typically have a material container arranged at the front of the road paver in the paving direction, said material container comprising a left container half and a right container half, each with a container floor, a rising container sidewall and a rising container rear wall. Additionally, road pavers normally comprise a longitudinal conveying device configured for the transport of paving material from the material container to a paving screed arranged at the rear of the road paver in relation to the paving direction. The paving direction designates the direction in which the road paver moves when paving. The longitudinal conveying device is normally arranged between the container halves and extends rearwards in the paving direction. When the road paver is in operation, paving material is typically delivered by truck and poured directly into the material container of the road paver. From here, the paving material is transported by means of the longitudinal conveying device to the rear of the road paver, where it is distributed transversely over the paving width and smoothed and compacted by the paving screed which typically floats on the paving material.

The container halves of the material container are typically adjustable and can be moved from a filling position in order to move paving material onto the longitudinal conveying device. For example, it is known that the container halves can be moved laterally in relation to the paving direction toward the middle of the machine, i.e., toward each other, in order to push the paving material in the material container together and onto the longitudinal conveying device. It is also possible for the container halves to be configured so as to be pivotable or tiltable about a pivot axis that runs essentially in the paving direction. By means of such a pivoting movement, the container halves pour the paving material stored in them onto the longitudinal conveying device generally arranged between the container halves, which carries the paving material off in the direction of the paving screed of the road paver. The container halves are thus adjustable between a filling position in which the receiving capacity of the material container is at a maximum and an emptying position in which the receiving capacity of the material container is at a minimum.

When in operation, road pavers typically go through comparatively large amounts of paving material per unit of time. In order to produce an even surface layer, it is important that the supply of paving material is continuous. For this reason, the material containers of road pavers typically have a very large capacity in order to accommodate a sufficient amount of paving material. As a result of the necessary capacity, the material containers of road pavers are typically very large and bulky machine elements, which, in particular, in the filling position in which the material container is at its maximum receiving capacity, partially protrude far beyond the machine frame of the road paver. As the material containers are frequently arranged at the front of the road paver in the paving direction, they often block the view of an operator on the driver's platform, in particular, when in the filling position, so that the latter cannot see where he/she is steering the road paver. However, it is generally necessary to operate as precisely as possible during road construction or a paving operation and, in particular, to guide the road paver accurately along a determined path. If the container halves are extended to a maximum or folded downward as far as they will go, the operator's view of the ground, in particular of the ground below the material container, as well as of the front travel units of the road paver is restricted. It can also happen that the operator of the road paver tries to make do by moving the containers halves out of the filling position immediately after the filling of the material container in order to improve the view to the front. This way, however, as outlined above, the capacity of the material container is reduced and paving material can fall out of the full material container to the front in the paving direction. In the worst case, material falling on the ground in this manner can lead to unevenness in the surface layer produced by the road paver.

In order to improve the viewing conditions of road pavers, e.g., EP 2 918 726 A1 proposes to install camera systems on the road paver and display corresponding camera images to the operator. This, however, leads to a considerable increase in the cost of manufacturing the road paver. Moreover, details regarding the exact direction of travel or the exact alignment of the travel units is often significantly more difficult to discern from camera images than when the corresponding areas of the road paver can be viewed directly.

It is thus the object of the present invention to provide a road paver that is as inexpensive as possible to manufacture and that simultaneously facilitates an improved field of vision for the operator in the paving direction. In particular, a precise steering of the road paver should be possible even when the material container is in the filling position.

SUMMARY OF THE INVENTION

Specifically, the present invention is achieved with a road paver as described above in which a container half comprises a viewing indentation that extends forward from the rear wall of the container in the paving direction to the container floor so that the ground can be viewed through it by an operator on the driver's platform. There is thus a recess in the material container, in particular, in the rear wall of the container and/or in the container floor so that a viewing indenation—through which areas normally covered by the material container are visible—is created in relation to what would normally be a continued extension of the respective planes of said container floor and rear wall. An indentation is thus provided in the material container that, compared to the adjacent sidewall, floor wall and/or rear wall of the container, extends into the material container and, in particular, into the material area of the material container. On the side of the material container opposite the material area, a viewing indentation is thus created that is configured in the form of an inward protrusion and that forms an unimpeded viewing space through which the operator on the driver's platform can look. The viewing indentation is, in particular, configured as a viewing channel or viewing shaft straight through the material container. The viewing indentation is also aligned from the perspective of the operator on the driver's platform with relevant ground areas for the purpose of navigating the road paver, e.g., with the ground that is, in particular, directly beneath the material container and/or that is in front of the viewing indentation in the paving direction under the material container and that e.g., is directly next to a front travel unit of the chassis of the road paver. This allows the operator of the road paver to view the critical front area of the chassis or the adjacent ground area, even when the material container is in the filling position, and thus to steer the road paver in a particularly precise manner along a determined path. At the same time, the present invention can be realized at a minimal cost and leads to a negligible reduction in the receiving capacity of the material container.

Accordingly, one aspect of the present invention is that a ground area is rendered visible to the operator on the driver's platform that is important or helpful for the steering of the road paver. This is, in particular, a front ground area in the paving direction underneath the road paver, which would otherwise be concealed by the material container when viewed from the driver's platform. In order to facilitate the precise steering of the road paver still further, it is preferred if at least one travel unit of the chassis is arranged beneath the material container and that the viewing indentation runs between the driver's platform and the part of the travel unit arranged beneath the material container in such a way that at least a portion of the side edge of the travel unit is visible through the viewing indentation for the operator on the driver's platform. In particular, the outer side edge of the travel unit, i.e., the side edge facing away from the middle of the machine, is visible through the viewing indentation. Viewed from the driver's platform, the viewing indentation thus extends through the material container in the direction of the front travel unit of the chassis, in particular, in the direction of the side edge of the latter. The travel unit of the road paver can be a crawler track or a wheel. The travel unit is located at least partially below the material container so that it would be concealed in accordance with a material container in the filling position according to the prior art. In order to view the side edge of the travel unit, the driver had to move the material container according to the prior art out of the filling position, thus causing the problems described in the introductory portion of this application. Through the viewing indentation according to the present invention, the operator can see the travel unit and, in particular, at least a part of the side edge of the latter from the driver's platform so that an adjustment of the material container for the precise steering of the road paver is no longer necessary. Unless otherwise expressly stated in the following, the explanations below apply to the container halves in the filling position, i.e., swung down and/or extended laterally as far as they will go. The visibility from the driver's platform here relates the normal operating position of an operator behind a suitable operating device on a driver's platform of a road paver, whether standing or sitting. The physical measurements of such a driver are summarized, e.g., in DIN 33402-2 "Ergonomie—Körpermaße des Menschen" (German Industrial Norm 33402-2 "Ergonomy—Anthropometry"). According to this norm, an average male driver will have a standing height of 175 cm with an eye level at 163 cm and a sitting height of 136 cm with an eye level at 124.5 cm (corresponding to the vertical distance H of the eyes to the floor of the driver's platform on which the operating person stands or sits). Alternatively, the beginning of the line of sight is further determined by the position of the operating person behind the operating device in the paving direction. The operating person here is in a standing or sitting position so that he/she can reach the at least one operating device with at least one hand within a comfort zone in accordance with the definition provided in DIN 33402-2. Specifically, this means that the eyes (point M in the description of the figures) of the (normed) operating person are positioned so that they are at a distance from the operating device (corresponding to the horizontal distance R in the description of the figures) in a range from 0 mm to 600 mm in a sitting position and in the range of 0 mm and 730 mm in the horizontal direction of paving.

In accordance with one embodiment of the present invention, at least a portion of the front side edge of the travel unit is visible. The greatest possible precision is achieved when, in particular, the front end of the travel unit is visible to the operator on the driver's platform. Therefore, according to one embodiment of the present invention, the viewing indentation extends from the rear wall up to a front end of the travel unit in such a way that the front end of the travel unit is visible through the viewing indentation. The operator can thus see, in particular, the side front end, i.e., the front edge or front corner of the travel unit facing away from the middle of the machine through the viewing indentation from the driver's platform. This way, the operator sees exactly in which direction the road paver is moving and can steer the paver accurately. The front end of the travel unit thus designates the front half (in case of a travel unit with one or several wheels) or the front quarter (in case of a travel unit in the form of a crawler track) of the longitudinal extension of the travel unit in relation to the longitudinal extension of the travel unit and, in particular, in relation to the ground or ground area visible from the driver's platform through the viewing indentation, the ground in question being transverse to the forward direction of the road paver next to the travel unit, i.e., the ground area directly adjacent to the front quarter of the travel unit to the outside. Ideally, and thus particularly preferably, the viewing indentation is configured in such a way that the beginning of the contact with the ground of the front end of the travel unit in the paving direction or the ground area directly adjacent to this front end of the travel unit transverse to the paving direction is visible through the viewing indentation. This enables the driver to maneuver the road paver in a particularly precise manner, as the latter can see the position of the outer side of the travel unit on the ground directly. It is thus also possible that the viewing indentation is configured in such a way that even the ground in front of the travel unit in the paving direction can be viewed through the viewing indentation. The viewing indentation thus extends in such a manner that a lateral front end of the travel unit is visible to the operator on the driver's platform through the viewing indentation.

Frequently, ground markings are provided that the driver can use for steering the road paver. In the simplest case, the driver uses such a marking to orient the lateral, outer edge of the chassis or the face side of the travel unit. In order to help the operator further, an orientation device or direction indicator is preferably arranged on at least one travel device of the chassis. For example, a suspended pendulum, an orientation stick or similar devices can be used on the travel unit or in the area of the travel unit, which help the operator with the exact steering of the paver. In this case, it is preferred if the viewing indentation is configured in such a way that the orientation device, at least the bottom part of the latter facing the ground, is visible for the operator on the driver's platform through the viewing indentation. In other words, the material container is configured in such a way that it forms a viewing channel or viewing shaft or viewing space in the form of a viewing indentation through which the operator of the road paver can see the orientation device as well as a portion of the ground beneath the orientation device. The viewing indentation preferably extends through the material container in such a way that the operator on the driver's platform can see at least a part of the orientation device, in particular the end facing the ground, as well as a part of the ground area lying below the orientation device. During paving operation, the driver can still align a ground marking with the orientation device, even when the container halves are swung down/extended as far as possible, and thus steer the road paver in a particularly precise manner in the paving direction.

Overall, the viewing indentation runs through the material container, as already described above. In particular, the viewing indentation runs through an area that belongs to the material area of the material container according to the prior art. The viewing indentation thus reduces the receiving capacity of the material container. In order to minimize this effect, the viewing indentation is advantageously not configured to be larger than necessary. It is thus, e.g., preferable if the viewing indentation is configured in such a way that its dimensions decrease toward the front in the paving direction, in particular, in such a way that its height decreases toward the front in the paving direction. Alternatively, or additionally, the lateral extension of the viewing indentation is configured to decrease toward the front in the paving direction. Preferably, the cross-sectional surface of the viewing indentation decreases along a line of sight starting from the driver's platform and running through the viewing indentation from the rear to the front in the paving direction. The viewing indentation is thus funnel-shaped towards the front so that it is wider and/or higher at the rear in the paving direction than at the front. This is sufficient because the areas under the material container that should be visible to the operator are close to one another while the operator should be able to see them from an array of positions on the driver's platform that is as extensive as possible. It is thus expedient to focus the viewing indentation from the driver's platform on the described areas of interest. This way, the areas of interest for the operator are rendered visible while a reduction of the capacity of the material container is limited to the greatest possible extent.

In principle, the viewing indentation can be configured in different ways. For example, it can be a tunnel, in particular a pipe-like and laterally delimited tunnel in relation to the line of sight that extends from the driver's platform at least partially through the material container and thus renders possible an unobstructed view of the ground below the material container or of the side edge of the travel unit or of the front end of the travel unit and/or of the orientation device arranged there. In this embodiment, the viewing indentation can be configured, e.g., as a pipe or can be delimited by a pipe. In one of the embodiments of the viewing indentation as a protrusion in the material container and, in particular, in the container rear wall and container floor, the viewing indentation can be configured to be round or vaulted. According to a variant that is particularly easy—and thus inexpensive—to manufacture, the viewing indentation is delimited vis-à-vis the material area of the material container by means of a ceiling in the paving direction, by means of an inner sidewall transversely to the paving direction toward the middle of the machine and by an outer sidewall away from the middle of the machine. Such a viewing indentation is configured to be open, in particular, vertically downward and to the rear in relation to the paving direction, in particular when the material container is in the filling position. It is particularly preferable to configure the viewing indentation as a tetrahedral recess, two side surfaces of the tetrahedron being formed by the inner and outer sidewalls, the lower side surface being formed by the edges of the recess and the adjacent floor wall of the container and the last sidewall being formed by the edges of the recess and the rear wall of the container. In other words, this type of recess is formed by two abutting sidewalls arranged obliquely in relation to each other.

In principle, the underside of the viewing indentation is preferably configured to be open over its entire extension in the paving direction.

The ceiling, the inner sidewall and the outer sidewall or only the inner and outer sidewall (tetrahedral recess) are preferably configured to be longitudinally extended in the vertical direction and in the paving direction and, in particular, as planar panels. Such flat panels are particularly easy to manufacture and process. This way, the recess in the material container and thus the viewing indentation is particularly easy to manufacture.

There is, however, a risk with the vaulted protrusion into the material area of the material container according to the present invention that paving material remains on the protrusion forming the viewing indentation when the container halves are swung upward and thus does not reach the longitudinal conveying device. It is thus preferable for said protrusion forming the viewing indentation to slope toward the container floor, in particular at every point of its surface in the material area. This way the paving material on the protrusion slides down to the container floor of the material container while the latter is being emptied. It is thus particularly preferred that the ceiling and/or inner sidewall and/or outer sidewall are configured so as to be inclined in relation to the horizontal plane when the container half is in the filling position, in particular at an angle in the range of 30° to 60°, preferably at an angle in the range of 40° to 50° and especially at an angle of 45°. This applies, in particular, to the edge between the inner and the outer sidewall in the case of a tetrahedral viewing indentation. The set angle is, in particular, selected in such a way that no flat, horizontal surface is produced when the container half is swung out as far as possible, but rather that the ceiling and/or the inner sidewall and/or the outer sidewall in this position are at an incline in relation to the horizontal plane. For example, the angle in relation to the horizontal plane can be 35°, 40° or 45°. This way, the paving material can be reliably and completely removed from the material container without any paving material remaining on the protrusion.

This effect is reinforced when at least the inner sidewall and/or the outer sidewall are also configured so as to be at an incline in relation to the paving direction. The inclination here relates to a vertical plane in the paving direction or parallel to the paving direction. It is preferable if the inner sidewall and/or outer sidewall are configured so as to be at an incline in relation to the paving direction, preferably at an angle in the range of 5° to 45°, particularly preferably at an angle in the range of 10° to 40°, in particular in the range of 15° to 35° and especially in the range of 20° to 30° in relation to the paving direction when the container half is in the filling position. The angle of inclination can thus be, e.g., 25°, 30° or 35°. Such an inclination furthers not only the sliding of the paving material off the protrusion in the material area of the material container, but also the narrowing of the viewing indentation in the paving direction. The inclination of the inner sidewall and/or of the outer sidewall in relation to the paving direction along the line of sight of an operator on the driver's platform can thus be aligned with the relevant areas beneath the material container. This also applies to the inclination of the ceiling in relation to the horizontal plane.

There are material containers in which the container halves are merely moved transversely to the paving direction towards each other in order to empty the paving material, in particular, in preparation for transport. In these kinds of material containers, the inclinations described above ensure that paving material does not remain on the protrusion forming the viewing indentation. In another kind of material container, the container halves are configured in such a way that they can be swung up about a pivot axis running in the paving direction in order to move paving material onto the longitudinal conveying device. The container halves are thus pivoted upward toward the longitudinal conveying device so that the paving material in the respective container halves is poured onto the longitudinal conveying device. In order to ensure that no paving material is left on the protrusion forming the viewing indentation in such a material container, it is preferable that at least the outer sidewall of the viewing indentation is configured to slope downward toward the middle of the machine or toward the longitudinal conveying device when the container half is in the upswung position. To this end, the angles already described above in relation to the horizontal plane or the paving direction are preferred. It can be ensured this way that, when the container halves are swung up, no paving material is left on the outer sidewall. On the whole, the material container is thus emptied completely.

An alternative possibility for ensuring the complete emptying of the material container consists in not permitting that paving material can get between the protrusion forming the viewing indentation and the container sidewall in the first place. Only paving material lying in this area risks remaining on the outer sidewall of the protrusion when the container sidewall is raised. It is thus preferable to provide a cover, in particular a sheet metal cover or the like, that covers the empty space in the material container between the sidewall and the container sidewall at least partially so that no paving material can penetrate this space. The cover thus extends, e.g., from the ceiling and/or from the outer sidewall to the container rear wall, the container floor and the container sidewall. The cover here is configured in such a way that it creates a dead space between the outer sidewall and the container sidewall that cannot be penetrated by paving material. This way, it can be ensured even in cases of a largely adhesive paving material that the material container can be completely emptied by pivoting the container halves upward. Simultaneously, the mounting of such a cover can be realized inexpensively.

Alternatively, the viewing indentation can be configured so as to be open toward the outside of the road paver transversely to the paving direction. In other words, the viewing indentation extends transversely to the paving direction through the material container right through to the side end of the latter. Accordingly, it is only delimited by an inner sidewall and a ceiling in this embodiment. The container side wall also has a recess or indentation that forms part of the viewing indentation in this embodiment. The ceiling of this embodiment runs continuously between the inner sidewall and the container sidewall so that it adopts the function of the cover in the embodiment just described above. By means of the viewing indentation configured outwards transversely to the paving direction, a particularly good view of the area beneath the material container is rendered possible for the operator and there is no risk of paving material settling on the outer sidewall of the viewing indentation.

The extension of the viewing indentation in the paving direction on the inner side of the container preferably corresponds to a maximum of 30% and, in particular, to a maximum of 20% of the maximum length of the container half, starting from the rear wall of the latter. This way, the reduction in terms of receiving capacity as a result of the viewing indentation in the container is kept low while adequate viewing conditions are created for the operator. Specifically, it is preferable, in particular, for compact pavers if the longitudinal extension of the viewing indentation is not greater than 60 cm, preferably not greater than 40 cm, and, in particular, not greater than 30 cm, measured from the rear wall in the paving direction.

In order to see through the viewing indentation, the operator must look past the lateral outer housing of the road paver. Depending on the configuration of the outer housing, it can be necessary for the operator on the driver's platform to move to the side in order to have an unimpeded view of the viewing indentation or through the same. In order to improve the viewing conditions for the operator still further, it is thus also preferable if the outer housing of the road paver comprises a recess towards the middle of the machine between the driver's platform and the container half so that, in conjunction with the viewing indentation in the container half, a continuous viewing channel is provided from the driver's platform when the container halves are in the filling position. In other words, an indentation or recess or niche is provided in the outer housing of the road paver which forms a viewing indentation in the outer housing which, together with the viewing indentation in the material container, forms a continuous viewing channel from the driver's platform through to the relevant areas beneath the material container described above. This way, the operator can be in the middle of the machine or at least close to the middle of the machine and still see the relevant areas by looking through the viewing indentations in the outer housing and the material container. The corresponding viewing indentation in the outer housing is of course also aligned with the viewing indentation in the material container or the relevant areas under the material container when viewed from the driver's platform. In particular, the viewing indentation in the outer housing and the viewing indentation in the material container are aligned when viewed from the driver's platform.

In order to render the steering of the road paver as flexible and as easy as possible in every paving scenario, it is also preferable if a viewing indentation is configured in each of the respective container halves, in particular in a structurally identical or symmetrical manner. An improved view of the relevant areas both front left and front right in the paving direction of the road paver is thus rendered possible for the driver.

BRIEF DESCRIPTION OF THE DRAWINGS

The present invention is described below in greater detail with the help of the embodiments shown in the figures, which show schematically.

Identical elements or elements with identical functions are designated with the same reference numbers. Elements visible in different figures are not necessarily separately designated with a reference number in each figure.

DETAILED DESCRIPTION OF THE INVENTION

Figure 1:
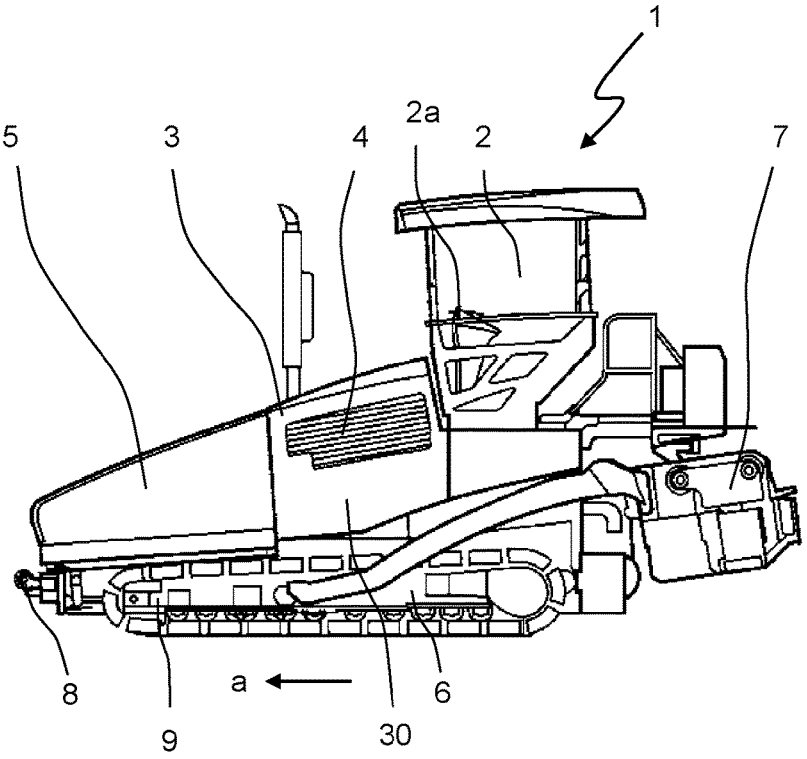
FIG. 1 is a side view of the road paver.

FIG. 1 shows a road paver 1 with a machine frame 3, a driver's platform 2, a drive motor 4, e.g., a diesel combustion motor, and a material container 5 arranged at the front in the paving direction a. The road paver 1 further comprises a chassis 6, whose left travel unit 9 is depicted in FIG. 1. Besides the crawler track shown, the road paver can alternatively comprise wheels. During a working operation, the material container 5 of the road paver 1 is filled with paving material by a truck driving in front of the road paver 1, said truck most often being pushed by the road paver 1 by means of push rollers 8. From the material container 5, the paving material is transported opposite the paving direction a to the rear of the road paver 1, where the paving screed 7 is located. The paving material is spread transversely to the paving direction a over the entire paving width and subsequently smoothed and compacted by the paving screed 7. The operation of the road paver 1 occurs here from a driver's platform 2 of the road paver 1. For this purpose, at least one operating device 2*a*, e.g., in the form of an operating panel or an operating console, is conventionally provided on the driver's platform. During a paving operation, the operator stands or sits on the driver's platform 2 behind the operating device 2*a* when viewed in the paving direction.

Figure 2:
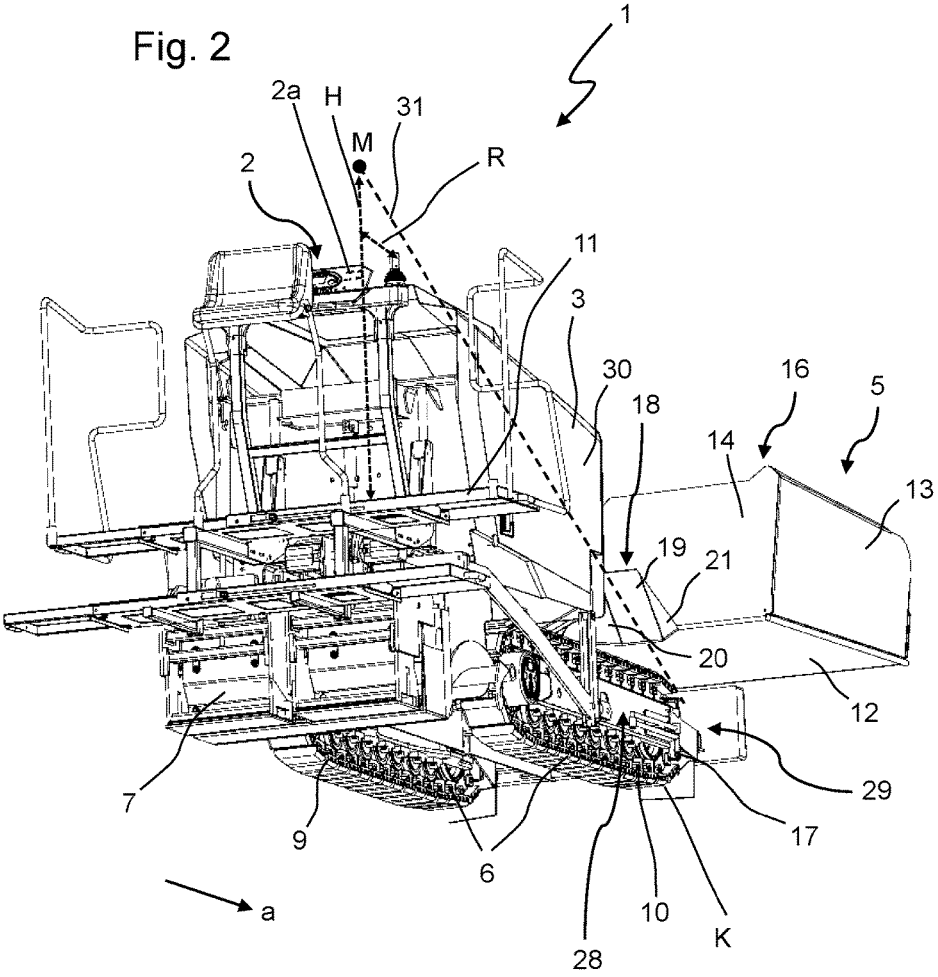
FIG. 2 is a perspective view of the road paver from the rear right and below.
Figure 3:
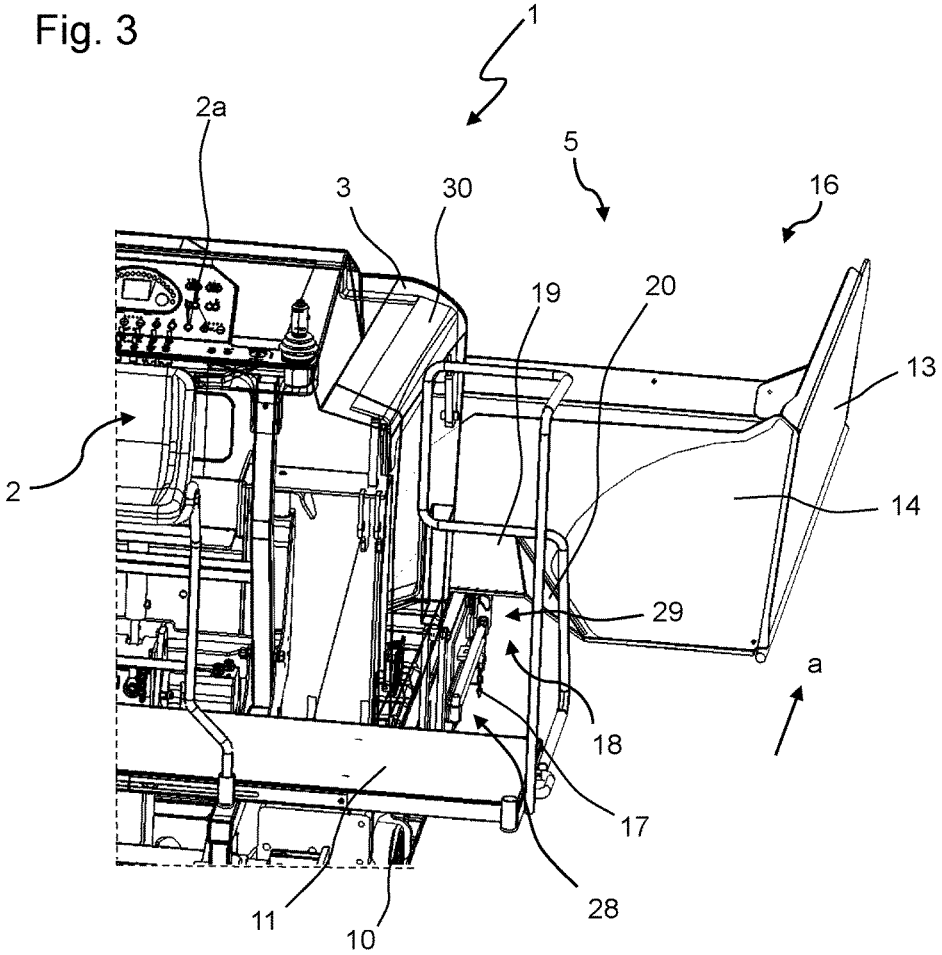
FIG. 3 is the view through the viewing indentation from the driver's platform of the road paver.

As shown, in particular, in FIGS. 2 and 3 with the example of the right container half 16 of the material container 5, the material container 5 protrudes with its container halves 16 far beyond the rest of the outer housing 30 of the road paver 1 in a direction transverse to the paving direction a, in particular when in the filling position. The driver's platform 2 of the road paver 1 has an operating platform 11, on which the operator of the road paver 1 can move around during operation. With its protruding container halves 15, 16, the material container blocks, in particular in the filling position, the view of the ground under the material container 5 as well as the view of the portion of the right travel unit 10 arranged in this area and, in particular, the side edge 28 of the latter. All descriptions regarding the right container half 16 and the right travel unit 10 also apply in a symmetrical fashion to the left container half 15 of the material container 5 and the left travel unit 9.

In order to improve the viewing conditions for the operator of the road paver 1, a viewing indentation 18 is provided in the material container 5 according to the present invention. The viewing indentation 18 allows the operator on the driver's platform 2 to view the ground under the material container 5 or the right travel unit 10. In the example shown, the viewing indentation 18 is formed in the container rear wall 14 and the container floor 12. It is delimited, in particular, by an inner sidewall 20, a ceiling 19 and an outer sidewall 21. The inner sidewall 20 delimits the viewing indentation 18 toward the middle of the machine, while the outer sidewall 21 delimits the viewing indentation 18 on the opposite side toward the outer side of the machine.

The ceiling delimits the viewing indentation 18 in the paving direction a to the front and upwards.

The viewing indentation 18 is thus formed by a recess in the material container 5 through which the operator on the driver's platform 2 can look. With the help of the dotted line in FIG. 2 illustratively depicting the line of sight 31 of the operator, it is not hard to recognize that that latter can view both the ground under the material container 5 as well as the portion of the right travel unit 10 arranged in this area, in particular the side edge 28 or front end 29 of the latter, through the viewing indentation 18. An orientation device 17, e.g., a pendulum, arranged on the right travel unit 10 can also be viewed by the operator through the viewing indentation 18. The viewing indentation 18 or the ceiling 19, inner sidewall 20 and outer sidewall 21 delimiting the viewing indentation are aligned along the line of sight 31 of the operator, in particular along the line of sight 31 starting at the driver's platform 2 and continuing through to the front end 29 or side edge 28 of the right travel unit 10 and/or to an orientation device 17 arranged on the right travel unit 10 or in the area of the latter. Preferably, the viewing indentation 18 in the container half 16 extends transversely to the paving direction a at least up until the side edge 28 of the travel unit 9, 10. In the present example, the operator on the driver's platform can see along the line of sight, in particular the front point of contact K of the travel unit 10 with the ground or the ground area directly adjacent to it as a part of the front quarter of the horizontal extension of the travel unit 10 in the paving direction. In particular, the front point of contact K is a part of the front quarter as well as of the front fifth of the longitudinal extension of the travel unit 10. This also applies to the other figures. Moreover, the viewing indentation 18 preferably extends over at least a fifth of the entire extension and of the longitudinal extension, respectively of the material container in the paving direction a. The starting point for the line of sight 31 in the paving direction a is the point M, which corresponds to the eye level of a male operator of average height in a standing or (when possible) in a slightly lower sitting position on the driver's platform behind the operating device 2*a* in the paving direction. Reference is made to the preceding statements with respect to specific vertical distances. The point M has a vertical height H from the floor of the driver's platform and a horizontal distance R in the paving direction a to the operating device 2*a*. With respect to specific measurement values and ranges regarding these variables, reference is made to the preceding statements.

In addition, the outer housing 30 of the road paver 1 can be provided with a recess so that a viewing channel exists in the outer housing 30. This viewing channel can be configured so as to be aligned with the viewing channel 18, in particular, when the container half in question is in the filling position (the position in which it is swung down and/or extended laterally as far as it will go) depicted in the figures so that an operator can view, in particular, the areas relevant for steering the road paver 1 beneath the material container 5 (in particular, a portion of the outer side area of the travel unit, the adjacent ground area and, if provided, at least the lower area of the orientation device) from the driver's platform 2 or operating platform 11 through this viewing channel. This way, the operator constantly has an eye on the alignment of the road paver 1, i.e., if it is moving along a ground marking, from the driver's platform 2 or operating platform 11 and can thus follow a determined path particularly closely, even when the container halves are in the filling position. The viewing indentation 18 thus ensures that the container halves do not affect the view of the driver adversely in terms of the navigation of the paver, i.e., do not block his or her view of the areas named above.

Figure 4:
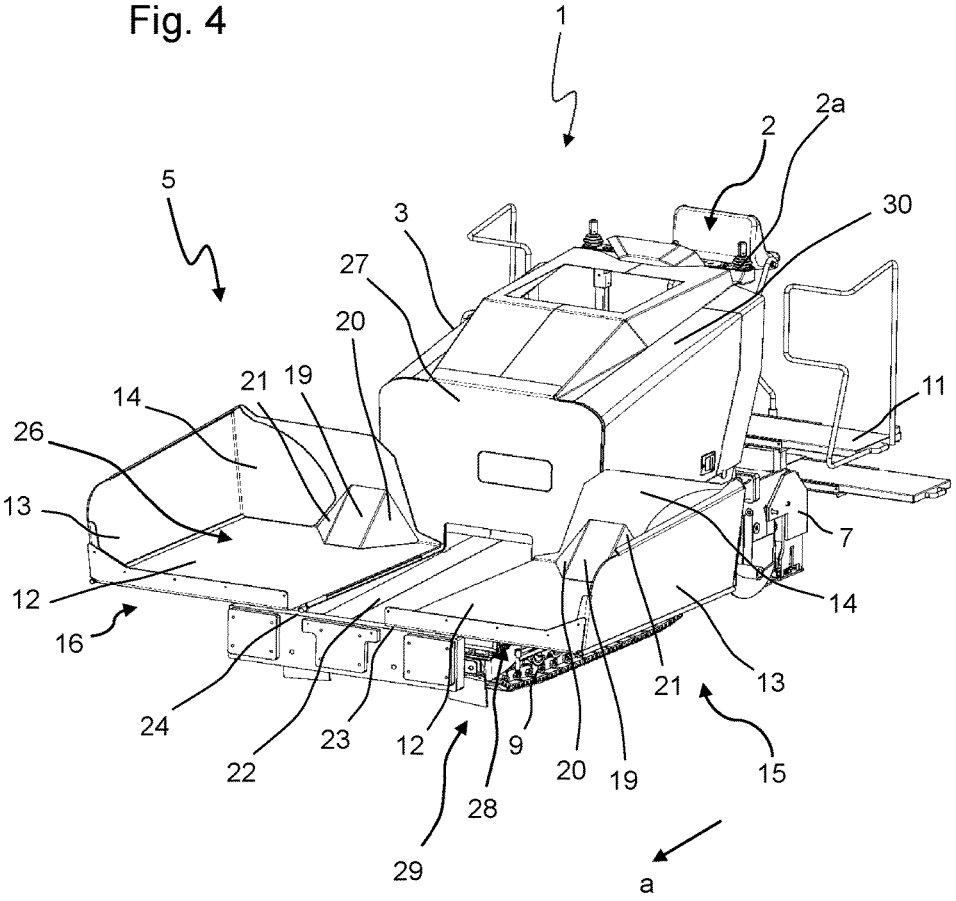
FIG. 4 is a perspective view of the material container of a road paver from the front left and above.
Figure 5:
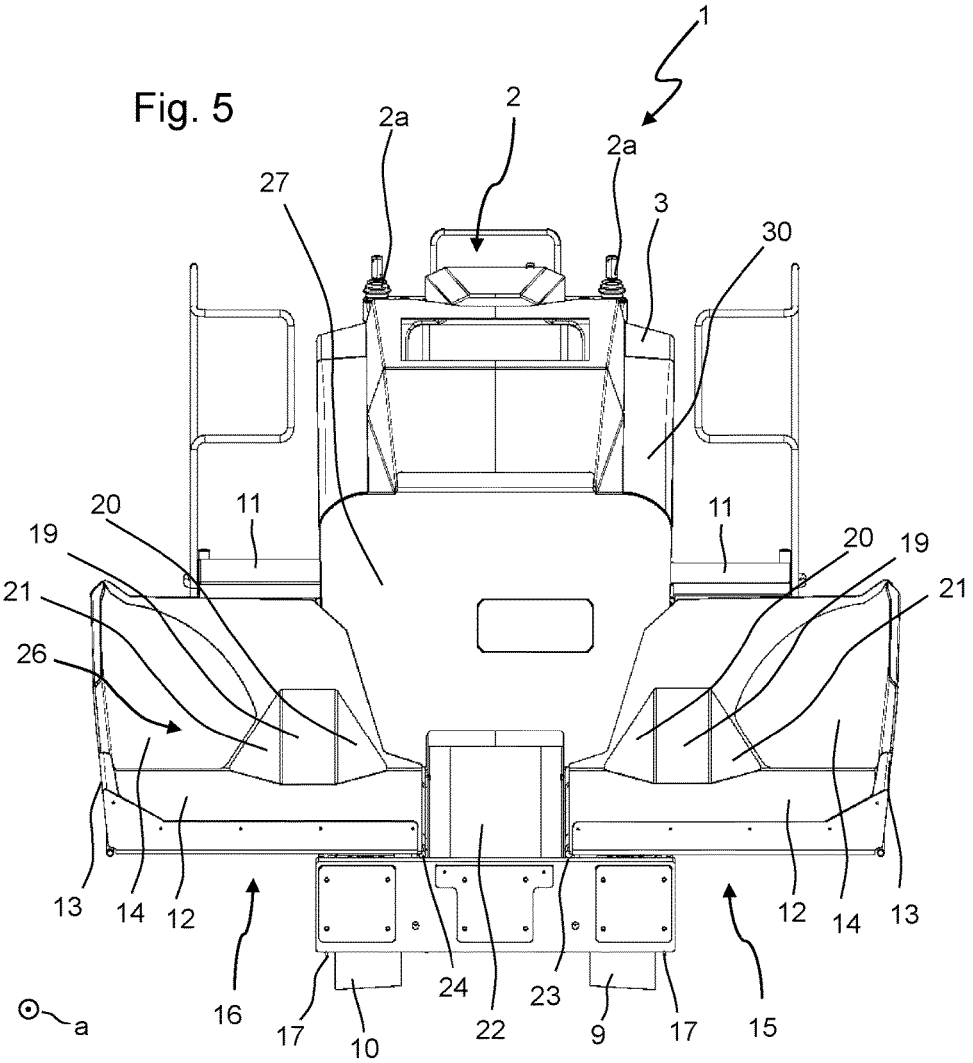
FIG. 5 is a front view of the material container of a road paver.

The structure of the material container 5 with the elements forming the viewing indentation 18 is visible, in particular, in the FIGS. 4 and 5, which depict the interior of the container. The material container 5 comprises a right container half 16 and a left container half 15, which are configured so as to be symmetrical in relation to each other and which both have a viewing indentation 18. Both container halves 15, 16 comprise a container floor 12, a container sidewall 13 and a container rear wall 14, the container sidewall 13 and container rear wall 14 rising vertically and the container floor 12 being configured to be essentially horizontal. Arranged between the container halves 15, 16 is a longitudinal conveying device 22, which is configured, e.g., as a scraper belt and which transports paving material from the material container 5 through the so-called tunnel to the rear of the road paver 1, where the latter is distributed transversely to the paving direction a and smoothed and compacted by the paving screed 7. The material container 5 is further completed by a rear wall 27 on the side of the frame. Together with the container rear walls 14 of the container halves 15, 16, the rear wall 27 delimits the material area 26 of the material container 5.

As can also be seen in FIGS. 4 and 5 and, in particular, FIG. 2, the ceiling 19, the inner sidewall 20 and the outer sidewall 21—which are configured in the present embodiment as panels, i.e., as flat, plane construction elements, e.g., metal sheets—form a recess or protrusion into the material area 26 of the material container 5. In the embodiment depicted in FIGS. 4 and 5, in particular, the container rear wall 14 and the container floor 12 are provided with a recess that forms the viewing indentation 18. The ceiling 19, the inner sidewall 20 and the outer sidewall 21 close off the material area 26 of the material container 5 downward and rearward in relation to the paving direction a. In order to prevent paving material from remaining on the elements forming the viewing indentation 18, the ceiling 19, inner sidewall 20 and outer sidewall 21 are configured so as to slope or slant toward the container floor 12, as described below.

Figure 6:
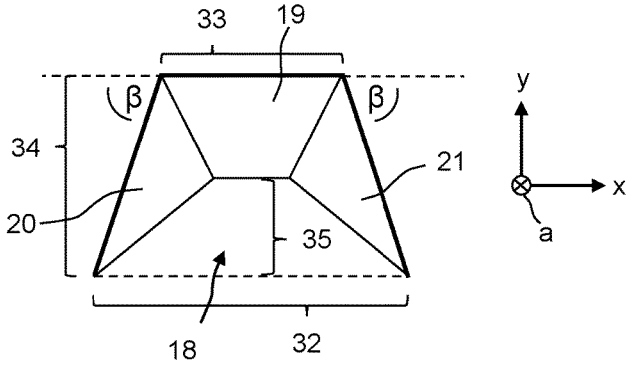
FIG. 6 is a perspective view of a viewing indentation from the rear.
Figure 7:
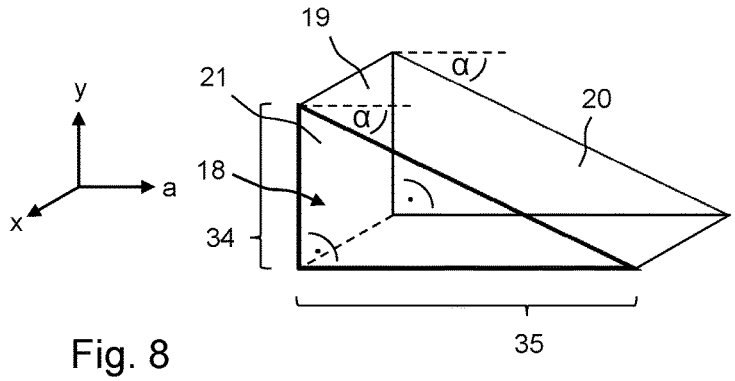
FIG. 7 is a perspective view of a viewing indentation from the side.
Figure 8:
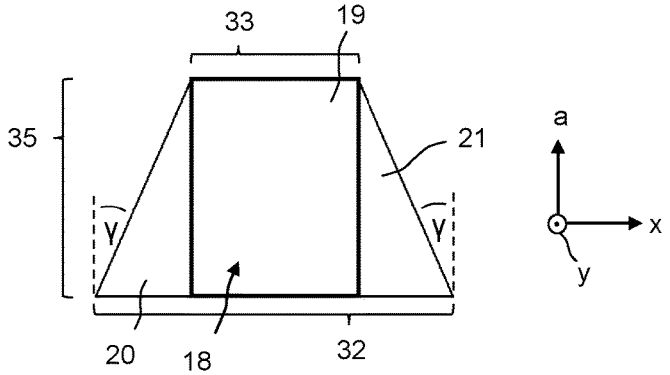
FIG. 8 is a perspective view of a viewing indentation from above.

The corresponding angles and exact geometrical shape of the viewing indentations 18 can be seen, in particular, in FIGS. 6, 7 and 8. These respectively depict perspective views of the surfaces and edges forming the viewing indentation 18. FIG. 6 shows the viewing indentation 18 from a perspective from behind the material container 5 looking in the paving direction a. FIG. 7 shows a side view of the viewing indentation 18, the paving direction a in FIG. 7 being oriented toward the right. FIG. 8, in turn, shows a top view of the viewing indentation 18 from above with the paving direction a oriented toward the upper edge of the figure. As one can see from these figures, the viewing indentation 18 has, in particular, a lower width 32, which defines the maximum extension of the viewing indentation 18 transversely to the paving direction a. Moreover, the viewing indentation 18 has an upper width 33, which corresponds to the width of the ceiling 19, and a height 34, which defines the maximum vertical extension of the viewing indentation 18. The maximum extension of the viewing indentation 18 in the paving direction a is designated as its length 35. The lower width 32 lies in a range, e.g., between 30 cm and 60 cm; the upper width 33 lies in a range, e.g., between 15 cm and 30 cm. The height 34 lies in a range, e.g., between 20 cm and 40 cm and the length 35 lies in a range, e.g., between 30 cm and 60 cm. The ceiling 19 comprises an angle $\alpha$ in relation to the horizontal plane, while the inner sidewall 20 and the outer sidewall 21 comprise an angle $\beta$ in relation to the horizontal plane, as already described above. As a consequence of the inclination of the ceiling 19 and sidewalls 20, 21 in relation to the horizontal plane, no paving material remains on the ceiling 19 or sidewalls 20, 21 so that the material container can be completely emptied. The sidewalls 20, 21 form an angle $\gamma$ with the paving direction a, i.e., with a vertical plane extending in the paving direction a. As a result of this angle $\gamma$ and the slant of the ceiling 19 in relation to the horizontal plane, the height of the viewing indentation decreases towards the front in relation to the paving direction a. The described angles are chosen, firstly, so as to avoid that paving material remains in the container after emptying and, secondly, so as to be aligned with the perspective line of sight of the operator from the driver's platform 2 to the ground under the material container or to the side edge 28 or the front end 29 of the travel unit 9, 10 and/or the orientation device 17. Thus, on the whole, a wedge-shaped viewing indentation 18 is created with respect to the adjacent rear wall and floor wall of the container. The viewing indentation 18 here corresponds to a slanted prism with a trapezoid-shaped surface area, the trapezoid-shaped surface area being configured to be, in particular, isosceles. The shape of the viewing indentation 18 is achieved by means of the corresponding ceiling 19, inner wall 20 and outer sidewall 21.

Figure 9:
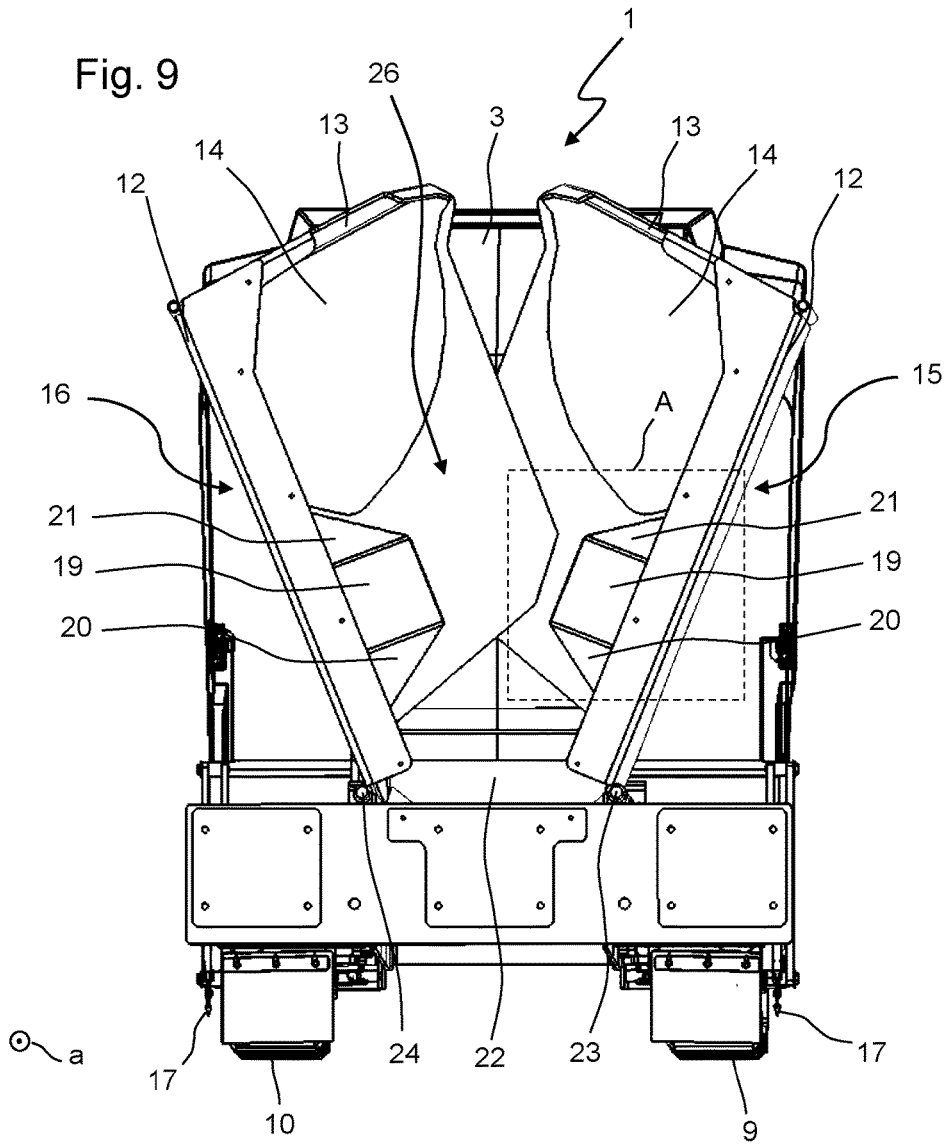
FIG. 9 is a front view of the material container of a road paver with the container halves in a swung-up position.
Figure 10:
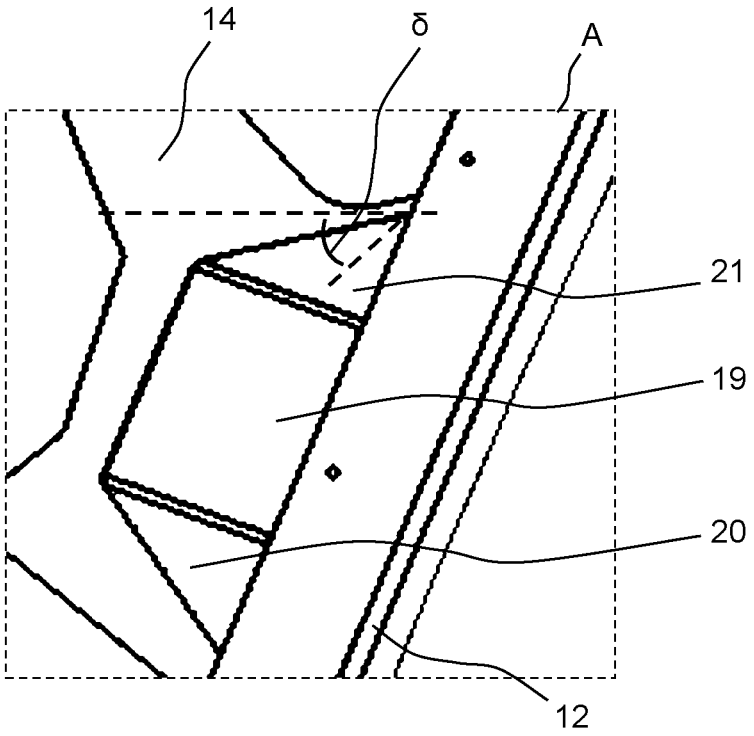
FIG. 10 is a detailed view of the section A shown in FIG. 9.

FIGS. 9 and 10 show an embodiment of the present invention in which the container halves 15, 16 are configured so as to be pivotable in an upward direction for the purpose of emptying the material container 5. Specifically, the left container half 15 and the right container half 15 are both configured to be upwardly pivotable about a pivot axis that is parallel to the paving direction a by means of a left container joint 23 and a right container joint 24, respectively. FIG. 9 shows the material container 5 with the container halves 15, 16 pivoted upward. In the position shown, the paving material is poured from the material container 5 and in particular from the material area 26 toward the middle of the machine onto the longitudinal conveying device 22. It is important here that in particular no paving material remains on the outer sidewall 21. FIG. 10 shows an enlargement of the section A depicted in FIG. 9. It is in particular visible in FIG. 10 that the outer sidewall 21 in the maximum raised position of the container halves 15, 16 forms an angle δ with the horizontal plane. The outer sidewall 21 in this position is configured to slope toward the longitudinal conveying device 22 so that paving material lying on the outer sidewall 21 slides down the latter and falls on the longitudinal conveying device 22.

Figure 11:
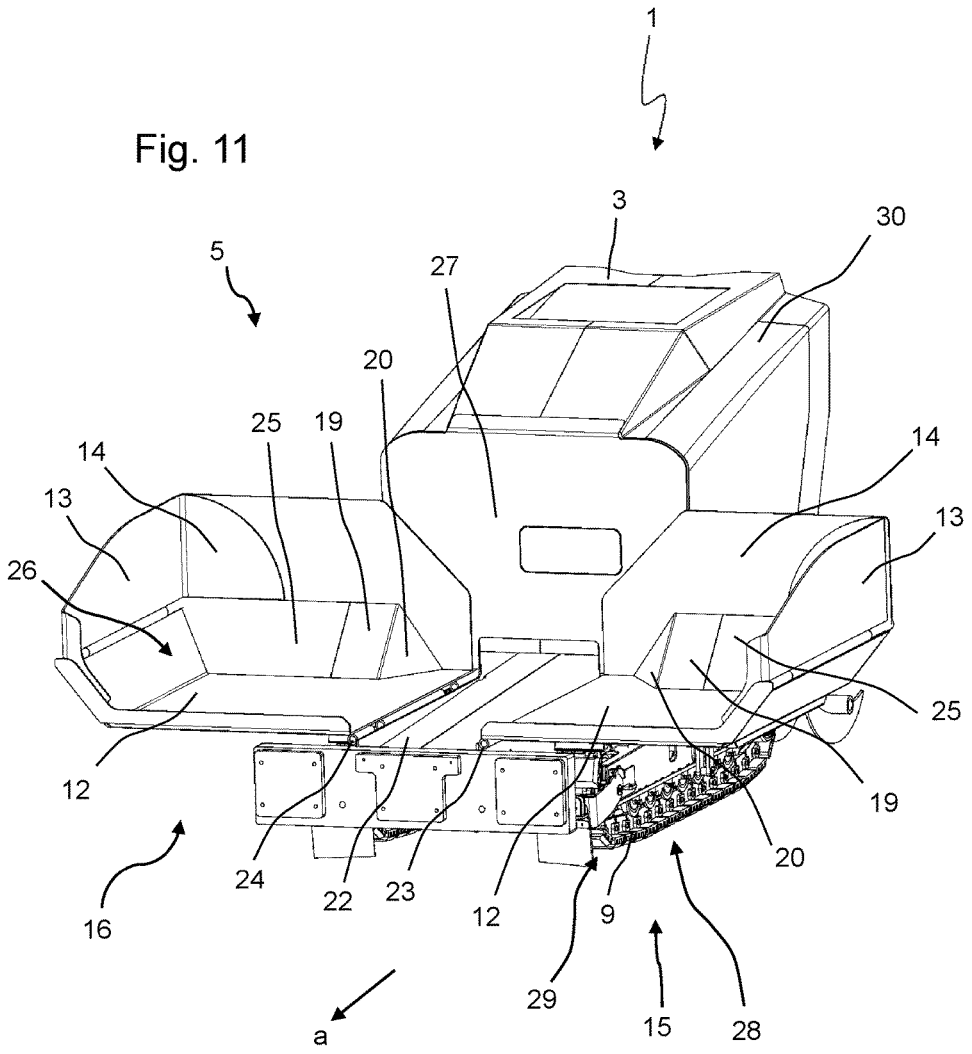
FIG. 11 is a perspective view of the material container of a road paver according to a further embodiment from the front left and above.

According to the embodiment of the present invention according to FIG. 11, in order to prevent largely adhesive paving material from remaining on the outer wall 21, a cover 25 is provided, which covers the empty space between the outer sidewall 21, the container floor 12, the container rear wall 14 and the container sidewall 13. The cover 25 is, e.g., configured as a metal sheet cover that extends from the ceiling 19 or outer sidewall 21 to the container sidewall 13 and that is also connected to the container rear wall 14 and the container floor 12 in a material-tight manner, e.g., by means of a welded connection. The cover 25 is in particular configured to have the same inclination as the ceiling 19, i.e., it runs parallel to the ceiling 19, and sits flush with the latter. As a result of the cover 25, paving material cannot penetrate between the outer sidewall 21 and the container sidewall 13 so that no paving material can remain in this area when the material container 5 is emptied.

Figure 12:
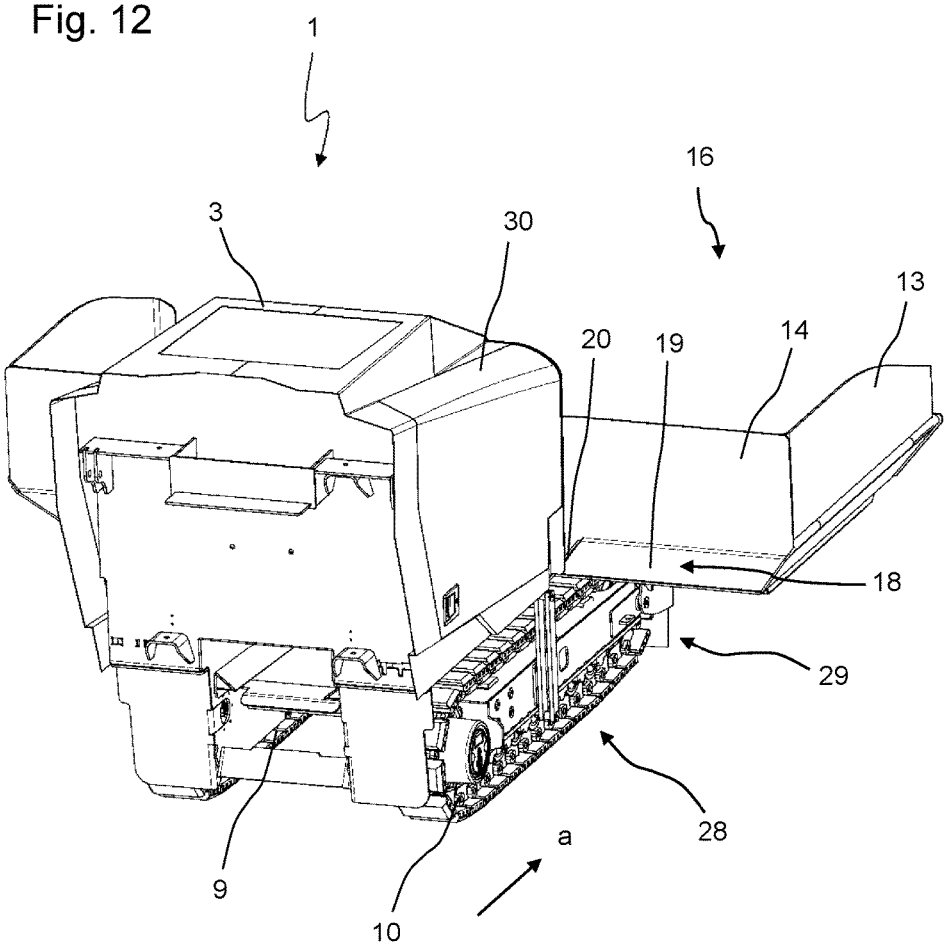
FIG. 12 is a perspective view of a further embodiment of a road paver from the rear right and below.
Figure 13:
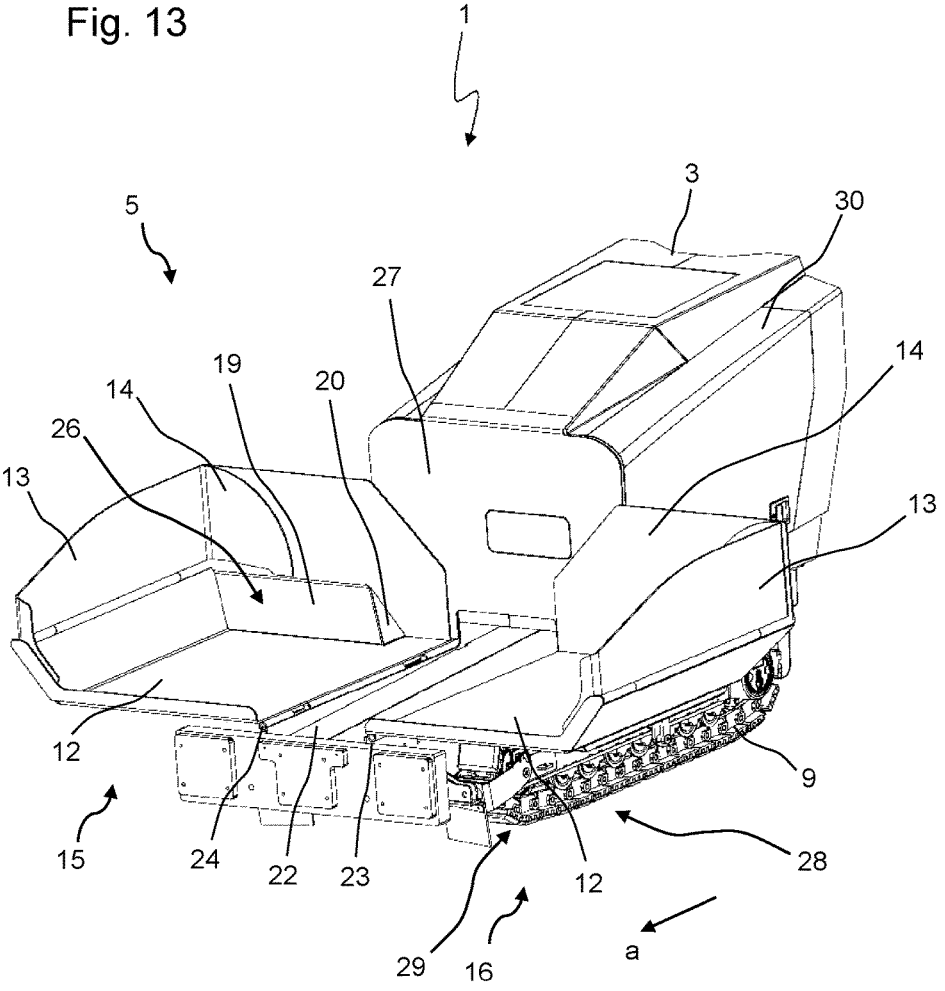
FIG. 13 is a perspective view of the material container of a road paver according to a further embodiment from the front left and above.

A further embodiment according to the present invention is shown in FIGS. 12 and 13. It differs from the previous embodiments in that the viewing indentation 18 is configured to be open toward the outside of the road paver 1, i.e., transversely to the paving direction a. The viewing indentation 18 is thus formed by recesses in the container floor 12, in the container sidewall 13 and in the container rear wall 14. It is delimited by an inner sidewall 20 and a ceiling 19. The lower, rear portion of the container halves 15, 16 slant forward in relation to the paving direction a so that a viewing indentation that is open to the outside is created, which extends at least from the outer side edge 28 of the travel units 9, 10 to the edge of the material container 5 running transversely to the paving direction a. The ceiling 19 according to this embodiment is configured analogously to the cover 25 of the preceding embodiment and extends in a similar fashion between the container rear wall 14, the container floor 12 and the container sidewall 13. This prevents paving material from getting stuck behind the viewing indentation 18 of the material container 5 while simultaneously creating an especially good field of vision in relation to the travel unit for the steering of the road paver 1 by the operator.

Figure 14:
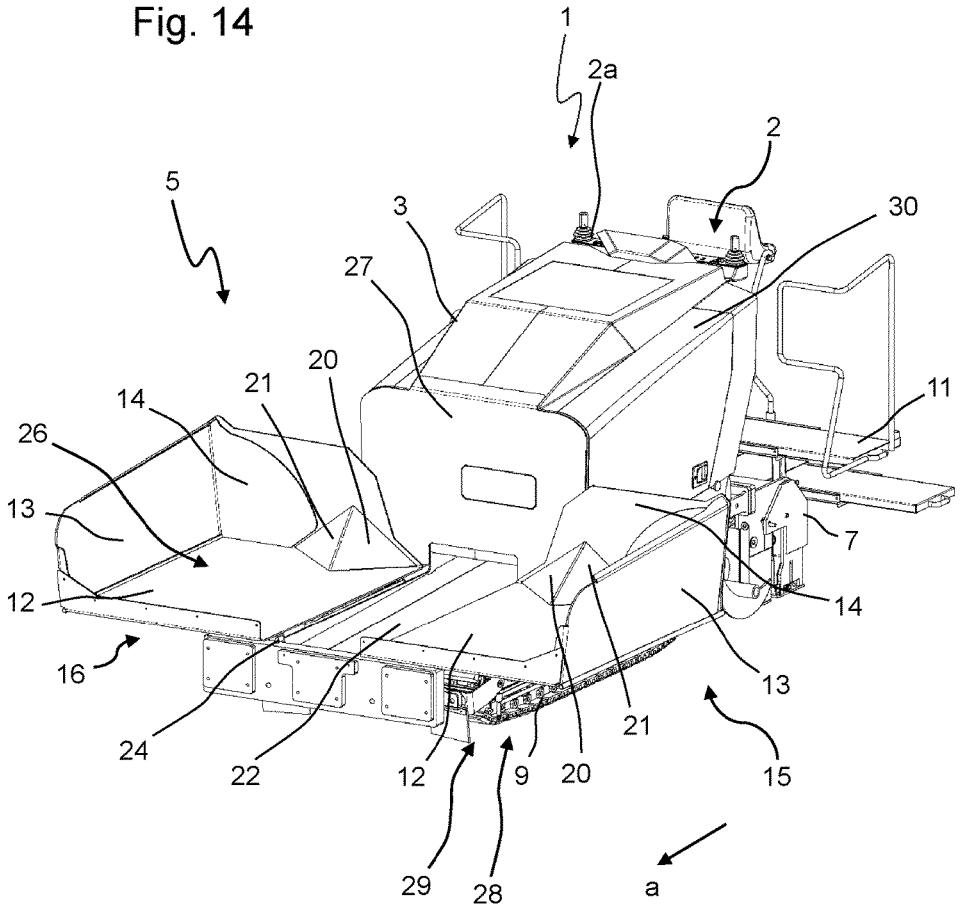
FIG. 14 is a perspective view of the material container of a road paver according to a further embodiment from the front left and above.
Figure 15:
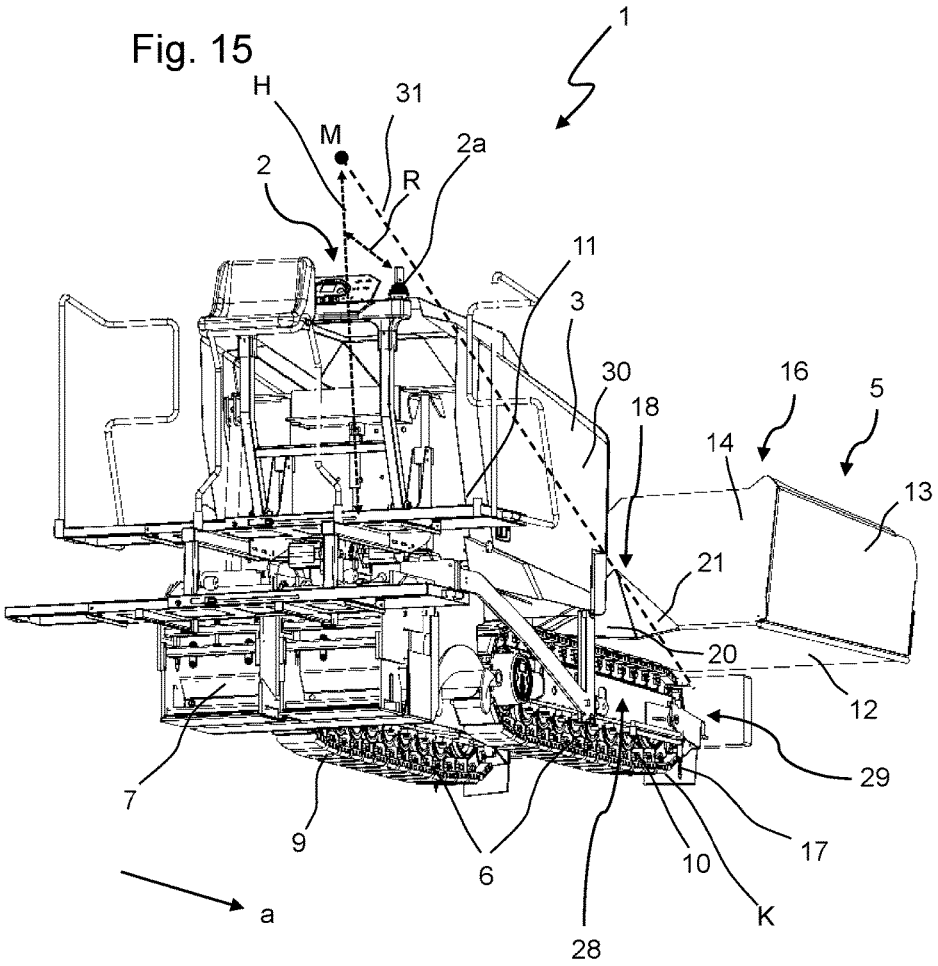
FIG. 15 is an oblique side view of the road paver shown in FIG. 14 from the rear right.

Finally, FIGS. 14 and 15 show a further particularly preferred variant of the viewing indentation 18, here in the shape of a tetrahedron. The respective side surfaces of the tetrahedron are formed by an inner sidewall 20, on one side, and an outer sidewall 21, on the other. The other surfaces result from the horizontal extension of the container floor 12 and the vertical extension of the container rear wall 14 beyond the viewing indentation 18. This variant has the great advantage that it is particularly easy to achieve, as merely two additional metal sheets need to be mounted in the container. Moreover, it has been shown that material deposits practically do not occur with this shape of viewing indentation 18.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A road paver for paving paving material in a paving direction (a), comprising:

a machine frame;

a driver's platform;

a drive motor;

a chassis with at least a left travel unit and a right travel unit;

a material container arranged at the front of the road paver in the paving direction (a) for receiving paving material, the material container comprising a left container half and a right container half, which respectively comprise a container floor, a rising container sidewall and a rising container rear wall; and a longitudinal conveying device configured to transport paving material from the material container to a paving screed arranged at the rear of the road paver in the paving direction (a), wherein the container halves can be moved out of the filling position in order to move paving material onto the longitudinal conveying device, wherein at least one container half comprises a viewing indentation, which extends from the container rear wall forward in the paving direction to the container floor in such a way that the ground is visible through the viewing indentation for an operator on the driver's platform, wherein at least one travel unit of the chassis is arranged beneath the material container and that the viewing indentation runs between the driver's platform and the part of the travel unit arranged under the material container in such a way that at least a part of the side edge of the travel unit is visible through the viewing indentation for the operator on the driver's platform, wherein the viewing indentation extends in such a way that a front side end of the travel unit is visible through the viewing indentation for the operator on the driver's platform, and wherein the viewing indentation is delimited vis-à-vis a material area of the material container in the paving direction (a) by a ceiling, transversely to the paving direction (a) toward the middle of the machine by an inner sidewall and away from the middle of the machine by an outer side wall or is configured in the shape of a tetrahedron.

2. The paver according to claim 1, wherein an orientation device is provided on at least one travel unit of the chassis and in that the viewing indentation is configured in such a way that the orientation device is visible through the viewing indentation for the operator on the driver's platform.

3. The paver according to claim 1, wherein the viewing indentation is configured so that its height decreases toward the front in the paving direction (a).

4. The paver according to claim 1, wherein the viewing indentation is configured so that its width or lateral extension decreases toward the front in the paving direction (a).

5. The paver according to claim 1, wherein the ceiling, the inner sidewall and the outer sidewall are configured to have a longitudinal extension in a vertical direction and in the paving direction (a) and are configured as flat panels.

6. The paver according to claim 1, wherein the ceiling and/or the inner sidewall and/or the outer sidewall are configured so as to be inclined in relation to the horizontal plane at an angle in the range of 30° to 60°.

7. The paver according to claim 1, wherein the inner sidewall and/or the outer sidewall are configured so as to have an inclination in relation to the paving direction (a) between 5° and 45°.

8. The paver according to claim 1, wherein the container halves are configured so as to be pivotable upward about a pivot axis running in the paving direction (a) in order to move paving material onto the longitudinal conveying device and in that the outer sidewall is configured so as to slope toward the middle of the material container in the swung-up position.

9. The paver according to claim 6, wherein a cover is provided, which at least partially covers an empty space in the material container between the outer sidewall and the container sidewall so that paving material cannot get into this empty space.

10. The paver according to claim 1, wherein the viewing indentation is configured to be open transversely to the paving direction (a) toward the outside of the road paver.

11. The paver according to claim 1, wherein an outer housing of the road paver at least partially comprises a recess toward the middle of the machine between the driver's platform and the container half so that, in conjunction with the viewing indentation, a continuous viewing channel from the driver's platform is provided.

12. The paver according to claim 1, wherein a viewing indentation is configured in each of the respective container halves.

13. The paver according to claim 1, wherein the ceiling and/or the inner sidewall and/or the outer sidewall are configured so as to be inclined in relation to the horizontal plane at an angle in the range of 40° to 50°.

14. The paver according to claim 1, wherein the ceiling and/or the inner sidewall and/or the outer sidewall are configured so as to be inclined in relation to the horizontal plane at an angle of 45°.

15. The paver according to claim 1, wherein the inner sidewall and/or the outer sidewall are configured so as to have an inclination in relation to the paving direction (a) between 10° and 40°.

16. The paver according to claim 1, wherein the inner sidewall and/or the outer sidewall are configured so as to have an inclination in relation to the paving direction (a) between 15° and 35°.

17. The paver according to claim 1, wherein the inner sidewall and/or the outer sidewall are configured so as to have an inclination in relation to the paving direction (a) between 20° and 30°.

* * * * *